US011019435B2

(12) United States Patent
Flaig et al.

(10) Patent No.: US 11,019,435 B2
(45) Date of Patent: May 25, 2021

(54) HEARING INSTRUMENT HAVING A COUPLING UNIT FOR THE VIBRATION-DAMPED MOUNTING OF A RECEIVER

(71) Applicant: SIVANTOS PTE. LTD., Singapore (SG)

(72) Inventors: Uwe Flaig, Feucht (DE); Hartmut Ritter, Neunkirchen (DE)

(73) Assignee: Sivanots Pte. Ltd., Singapore (SG)

( * ) Notice: Subject to any disclaimer, the term of this patent is extended or adjusted under 35 U.S.C. 154(b) by 0 days.

(21) Appl. No.: 16/541,862

(22) Filed: Aug. 15, 2019

(65) Prior Publication Data

US 2020/0068322 A1 Feb. 27, 2020

(30) Foreign Application Priority Data

Aug. 24, 2018 (DE) ..... 102018214323.4

(51) Int. Cl.
*H04R 25/00* (2006.01)

(52) U.S. Cl.
CPC ..... *H04R 25/604* (2013.01); *H04R 25/456* (2013.01)

(58) Field of Classification Search
CPC ..... H04R 25/604; H04R 25/456
USPC ..... 381/324
See application file for complete search history.

(56) References Cited

U.S. PATENT DOCUMENTS

| | | | | |
|---|---|---|---|---|
| 3,048,668 | A * | 8/1962 | Weiss | H04R 25/60 381/338 |
| 4,588,867 | A | 5/1986 | Konomi | |
| 4,854,415 | A * | 8/1989 | Goschke | H04R 25/60 181/130 |
| 8,218,803 | B2 | 7/2012 | Fickweiler et al. | |
| 9,319,817 | B2 | 4/2016 | Baer et al. | |
| 10,051,383 | B2 | 8/2018 | Margot et al. | |
| 2002/0106096 | A1* | 8/2002 | Vonlanthen | H04R 25/48 381/330 |
| 2007/0110270 | A1* | 5/2007 | Tipsmark | H04R 25/456 381/374 |
| 2008/0112584 | A1 | 5/2008 | Karamuk | |
| 2010/0069705 | A1 | 3/2010 | Schumaier | |
| 2011/0188690 | A1 | 8/2011 | Larsen et al. | |
| 2014/0333012 | A1* | 11/2014 | Riepenhoff | B29C 64/112 264/401 |
| 2017/0094422 | A1* | 3/2017 | Margot | H04R 25/604 |

FOREIGN PATENT DOCUMENTS

| | | | |
|---|---|---|---|
| CN | 101389157 | A | 3/2009 |
| CN | 102132587 | A | 7/2011 |
| CN | 104041077 | A | 9/2014 |
| CN | 106878898 | A | 6/2017 |
| DE | 102010009782 | A1 | 9/2011 |
| EP | 0092822 | A2 | 11/1983 |
| EP | 2795923 | B1 | 11/2015 |
| WO | 0069216 | A2 | 11/2000 |

* cited by examiner

*Primary Examiner* — Sean H Nguyen
(74) *Attorney, Agent, or Firm* — Laurence A. Greenberg; Werner H. Stemer; Ralph E. Locher

(57) ABSTRACT

A hearing instrument includes a housing, a receiver and at least one other component mounted in the housing, in particular a battery and/or an electronic frame. The hearing instrument also has a coupling unit for the vibration-reduced mounting of the receiver. The receiver is elastically coupled by the coupling unit to the at least one additional component.

8 Claims, 3 Drawing Sheets

HEARING INSTRUMENT HAVING A COUPLING UNIT FOR THE VIBRATION-DAMPED MOUNTING OF A RECEIVER

CROSS-REFERENCE TO RELATED APPLICATION

This application claims the priority, under 35 U.S.C. § 119, of German application DE 10 2018 214 323.4, filed Aug. 24, 2018; the prior application is herewith incorporated by reference in its entirety.

BACKGROUND OF THE INVENTION

Field of the Invention

The invention relates to a hearing instrument. The term "hearing instrument" generally refers to devices that receive an ambient sound, modify it by signal-processing techniques and output a modified acoustic signal to the auditory system of a person (a "wearer") wearing the hearing aid.

A hearing instrument which is constructed to treat a hearing-impaired wearer and which processes, in particular amplifies, the ambient acoustic signals in such a way that a hearing loss is wholly or partially compensated, is referred to herein and in the following as a "hearing aid." To that end, a hearing aid usually includes an input transducer, for example in the form of a microphone, a signal processing unit with an amplifier, and an output transducer. The output transducer is typically implemented as a miniature loudspeaker and is also referred to as a "receiver."

In addition to hearing aids, however, there are also hearing instruments aimed at assisting people with normal hearing, to protect the auditory canal of the wearer or to provide support in the perception of sound in noise (e.g. speech comprehension in complex noise environments) for specific purposes. Such hearing instruments are often constructed in a similar way to hearing aids and also include, in particular, the above components of input transducer, signal processing and output transducer.

Different configurations of hearing instruments are available in order to satisfy the wide range of individual requirements. In the case of so-called BTE (Behind-the-Ear) hearing instruments, a housing fitted with the input transducer, the signal processing and a battery is worn behind the ear. Depending on the configuration, the receiver can be positioned either directly in the auditory canal of the wearer (so-called ex-receiver hearing instruments or receiver-in-the-canal, abbreviated to RIC hearing instruments). Alternatively, the receiver is disposed inside the housing itself. In such cases, a flexible sound tube, also known simply as a "tube," directs the acoustic output signals of the receiver from the housing to the auditory canal (tube-based hearing instruments). In the case of so-called ITE (In-the-Ear) hearing instruments, a housing, which contains all of the functional components including the microphone and the receiver, is worn at least partially inside the auditory canal. So-called CIC (completely-in-canal) hearing instruments are similar to the ITE hearing instruments, except that they are worn completely inside the auditory canal.

Regardless of the configuration, a secure and, in particular, vibration-damped mounting of the receiver within the housing of the hearing instrument is crucial, in particular to prevent as far as possible sound transmission (in the form of airborne and structure-borne sound) within the housing and any resulting acoustic feedback between the receiver and the microphone as well as vibrations of the entire housing.

In order to achieve an effective vibration damping, the receiver of a hearing instrument is usually mounted with individually shaped supports, which are adapted both to the particular receiver configuration and to the available space in the hearing instrument and the power of the hearing instrument, and which are normally supported on the housing of the hearing instrument. Currently, the attenuation of a receiver is carried out by using a rubber band or a rubber boot wrapped around the rear portion of the receiver, thus preventing the receiver from impinging against the hard housing wall of the hearing instrument. In addition, receivers are often enclosed in chambers made of plastic or metal, to avoid transmission of airborne sound within the housing of the hearing instrument as far as possible.

SUMMARY OF THE INVENTION

It is accordingly an object of the invention to provide a hearing instrument having a coupling unit for the vibration-damped mounting of a receiver, which overcomes the hereinafore-mentioned disadvantages of the heretofore-known instruments of this general type and which enables a secure and vibration-damped mounting of the receiver within the hearing instrument.

With the foregoing and other objects in view there is provided, in accordance with the invention, a hearing instrument having a housing, a receiver, at least one additional component mounted in the housing and a coupling unit for the vibration-reduced mounting of the receiver. The receiver (independently of the housing) is elastically coupled to the at least one additional component by the coupling unit detached from the housing.

An elastic coupling is understood to mean a mechanical coupling between the receiver and the at least one additional component, which allows a relative motion of the receiver and the at least one additional component, namely a deflection of the relative position from a resting position at least within a certain range, but which counteracts this deflection with a restoring force. In reality, an elastic force transmission through the physical coupling unit is always associated with friction and thus with a loss of mechanical energy.

The invention is based firstly on the consideration that a direct or indirect mounting of the receiver on the housing wall of the hearing instrument can be counter-productive for the intended effect of vibration and sound attenuation, because vibrations of the receiver—to the extent to which they cannot be intercepted by any intermediate damping—are coupled into the housing and thus inadvertently transmitted relatively effectively. Secondly, the invention also takes into account the experience that other components of the hearing instrument, in particular the battery, can amplify the vibrations caused by the receiver if such components are themselves set into vibration by these vibrations. Under unfavorable circumstances, this can cause, in particular, resonance effects or a mechanical feedback of the vibrations of the receiver and the battery or another component of the hearing instrument. Sometimes, due to the induced vibration of internal components, the housing of the hearing instrument can also be set into a noticeable (and thus unpleasant for the wearer) vibration. In order to avoid these effects, conventional hearing aids can only be operated with a comparatively low gain, in particular in the high frequency ranges.

The conclusion according to the invention derived from the above-mentioned consideration is that it may make sense to reduce the mechanical coupling of the receiver with the housing. In spite of the experience that even a coupling between the receiver and at least one additional component of the hearing instrument can be detrimental to the desired vibration damping, according to the invention such a coupling is nevertheless intentionally used. This is based on the recognition that by the deliberate creation of an elastic coupling, the receiver and the at least one other component counteract each other with regard to their respective movement in the operation of the hearing instrument, and as a result can reduce the vibration transmitted into the hearing instrument overall, wherein in addition, due to the above-mentioned friction effects mechanical energy can be efficiently dissipated by the coupling unit (i.e. converted into heat and thus "destroyed").

In a preferred configuration the at least one additional component, to which the receiver is elastically coupled through the coupling unit, is a battery and/or an—optionally present—electronic frame of the hearing instrument. An electronic frame is understood to mean a mechanical support structure separated from the housing of the hearing instrument, on which at least one electronic component, in particular a signal processing unit, of the hearing instrument is supported. Usually the entire electronics of the hearing instrument, or at least a majority thereof, is mounted on the electronic frame. The electronic frame thus makes it possible, in order to simplify the manufacturing process, to pre-assemble the electronics of the hearing instrument completely or partially outside of the housing and, if appropriate, to test it and insert it in the housing in the already pre-assembled condition. The battery and the electronic frame, if present and fitted, are usually the heaviest components of the hearing instrument. The elastic coupling of the receiver to at least one of these components is therefore especially advantageous for the vibration-damped anchoring of the receiver. In particular, high vibration frequencies are damped particularly effectively by the high dead weight of the module formed of the receiver, the coupling unit and the battery and/or the electronic frame.

A straightforwardly realizable, but in terms of the damping characteristics particularly favorable, elastic coupling is preferably achieved by the fact that the coupling unit is constructed with a damping body made of rubber or an elastomer material, which is directly or indirectly coupled, on one hand, to the receiver and, on the other hand, to the at least one additional component, thus in particular, the battery and/or the electronic frame.

In a particularly advantageous configuration of the invention the coupling unit includes an elastic damping element in addition to the damping body, which damping element engages directly with the receiver for mounting the latter, and a cage which surrounds this damping element and to which the damping body is fixed. This cage, which is therefore positioned between the (receiver-side) damping element and the damping body (facing the additional component) in a force-transmission sense, is produced in particular from a harder material than the damping element and the damping body. In other words, both the elastic damping element as well as the damping body thus have a lower hardness than the cage. This sequence of—seen from the receiver—the soft material of the damping element, the hard material of the cage and again the soft material of the damping body has proved to be particularly suitable for a stable but at the same time vibration-reducing mounting of the receiver, effective in both high and low frequency ranges. In a particularly suitable configuration, the elastic damping element has a lower hardness than the damping body.

In an advantageous configuration, the coupling unit has at least one fixing element to provide a force-locking fixing of the at least one additional component. For example, the coupling unit includes two fixing elements opposite each other and a distance apart, which clamp the battery between them. As a result of the force-locking fixing (i.e., the fixing of the additional component by the exertion of a shear force by the fixing element, so that a movement of the additional component relative to this fixing element is only possible by overcoming a friction force), the additional component is advantageously held without play, which means that even small vibration amplitudes are damped and hard impacts between the component and the coupling unit can be avoided.

The coupling unit and, in particular, the or each fixing element are constructed with regard to their shape (e.g. using a chamfer, fins, cavities or other surface structures) and their material properties (for example, coefficients of friction, hardness, elasticity, memory effect, etc.) in such a way that expected manufacturing tolerances of the other component are compensated so that, for example, batteries that turn out to be larger or smaller within the range of the manufacturing tolerances are always held sufficiently well. The or each fixing element is preferably constructed integrally with the damping body for a simple but effective configuration of the coupling unit.

In a particularly synergistic configuration of the coupling unit, the fixing element also provides an electrical contact with the battery and/or an electronic component of the hearing aid. In this configuration, corresponding electrical connections are integrated into the coupling unit, and in this case in particular into the fixing element, if present, or at least one of the fixing elements, if present.

Other features which are considered as characteristic for the invention are set forth in the appended claims.

Although the invention is illustrated and described herein as embodied in a hearing instrument having a coupling unit for the vibration-damped mounting of a receiver, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
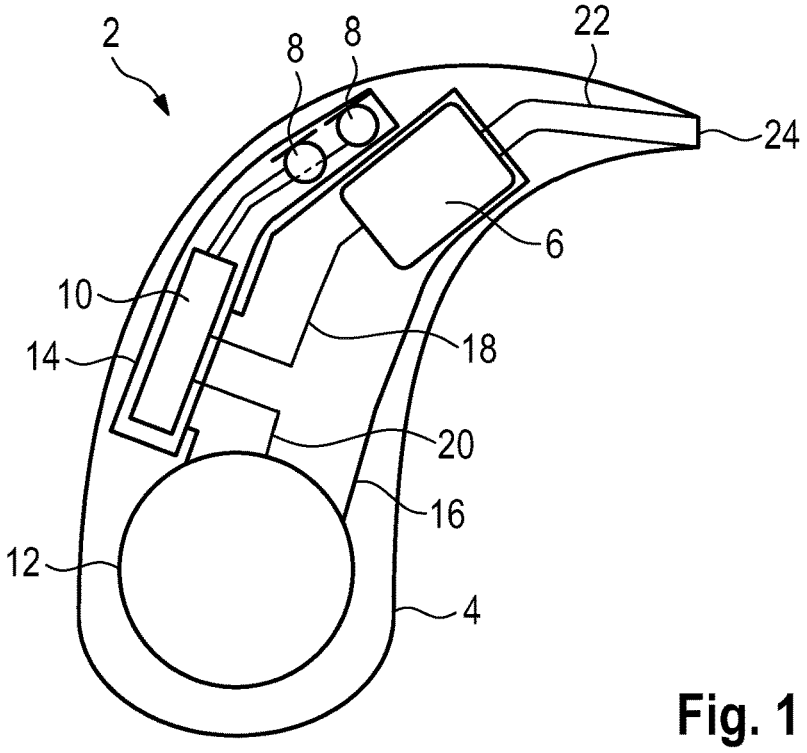
FIG. 1 is a diagrammatic, longitudinal-sectional view of a hearing instrument with a housing, a receiver, a battery, a signal processing unit and a coupling unit which couples the receiver elastically to the battery and to the signal processing unit.
Figure 2:
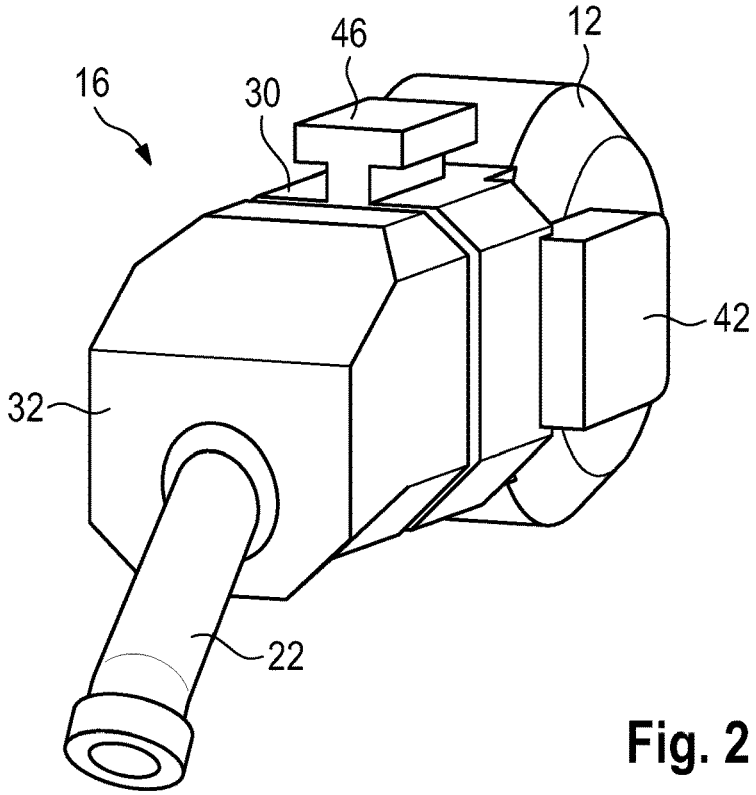
FIG. 2 is a perspective view of the coupling unit with the battery fixed thereto.
Figure 3:
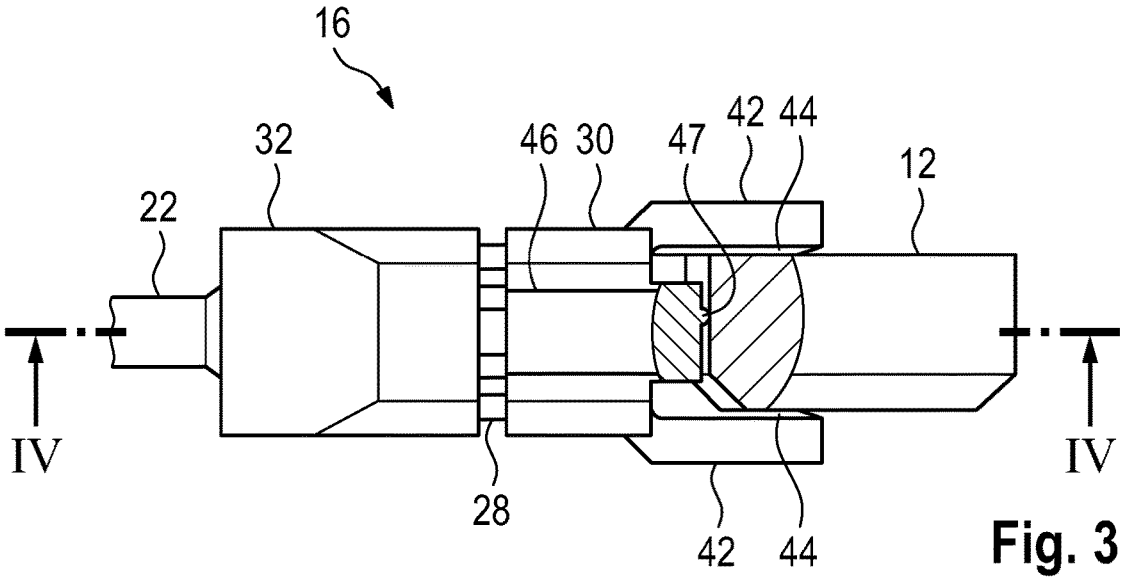
FIG. 3 is a partially broken-away, side-elevational view of the coupling unit and the battery.

Referring now in detail to the figures of the drawings, in which corresponding parts are provided with identical reference numerals, and first, particularly, to FIG. 1 thereof, there is seen a basic diagrammatic illustration of a hearing instrument 2 in the form of a (BTE) hearing aid to be worn behind the ear by a hearing-impaired wearer.

The hearing instrument 2 includes a housing 4, in which a receiver 6, two microphones 8, a signal processing unit 10 with a digital signal processor and/or a microcontroller, and a battery 12 are disposed as main components.

A majority of the electrical and electronic components of the hearing instrument 2, in particular the signal processing unit 10 and the microphones 8, are mounted on an electronic frame 14. The electronic frame 14 is a structure manufactured separately from the housing 4, in particular of plastic, on which the associated electrical and electronic components, thus in particular the signal processing unit 10 and the microphones 8, can be pre-assembled outside the housing 4.

The receiver 6, the battery 12 and the electronic frame 14, fitted with the signal processing unit 10 and the microphones 8, are in turn elastically coupled to each other by a coupling unit 16. The signal processing unit 10 also electrically contacts the receiver 6 and/or the battery 12 through electrical wires 18 and 20 due to the use of the coupling unit 16. The sound generated by the receiver 6 is routed by a sound tube 22 to an opening 24 at a tip of the housing 4. From there, the sound is directed through an extension of the tube 22, which is not explicitly shown, into the ear of the wearer.

The coupling unit 16 is shown in detail in FIGS. 2 to 5. The internal structure of the receiver 6 and the battery 12 is not explicitly shown in the sectional drawings of FIGS. 3 and 4 for simplification purposes. It is apparent from FIGS. 2 to 5, in particular the sectional view according to FIG. 4, that the coupling unit 16 includes a damping element 26 for mounting the receiver 6, a cage 28 surrounding the damping element, and a damping body 30 disposed between the cage 28 and the battery 12. A cap 32 is additionally placed onto the cage 28 on the opposite side of the cage 28 from the battery 12. This cap 32 does not contribute directly to the elastic coupling between the receiver 6, the battery 12 and the signal processing unit 14. However, in a manner described in detail below, the cap 32 interacts with the damping element 26, the cage 28 and the damping body 30 to provide the sound damping of the receiver 6. In this respect it is also construed as a functional component of the coupling unit 16.

Figure 4:
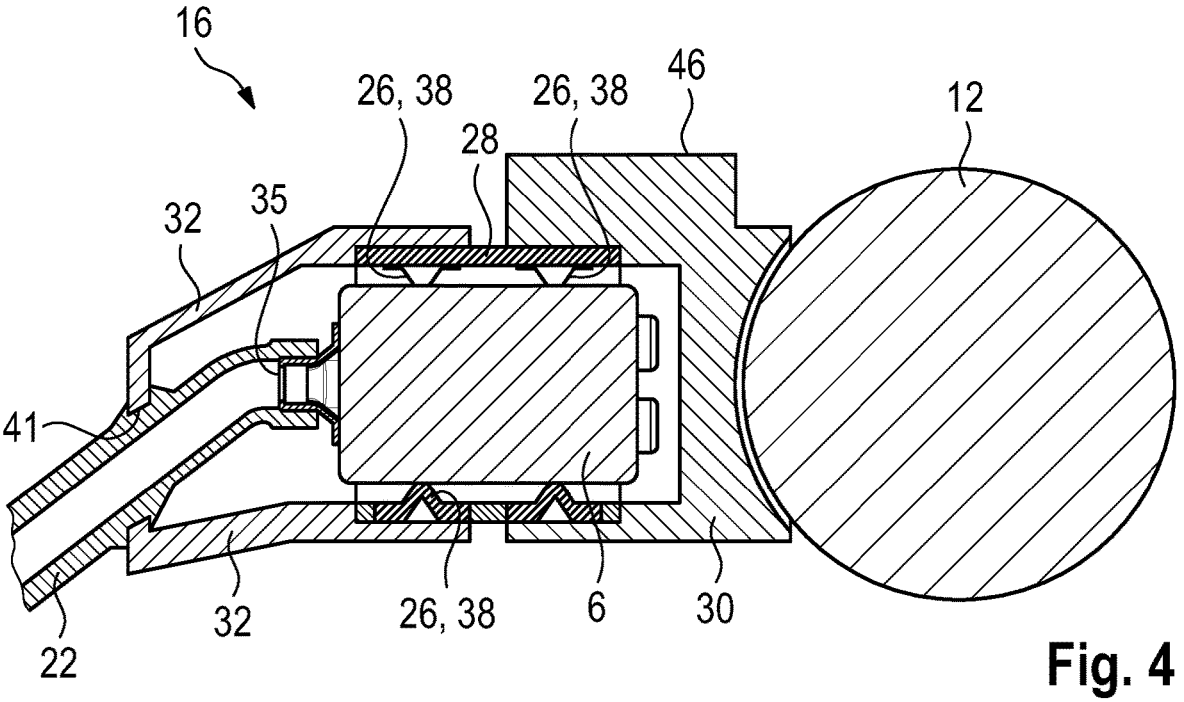
FIG. 4 is a fragmentary, longitudinal-sectional view of the coupling unit and the battery as well as the receiver mounted in the coupling unit by an elastic damping element and a cage surrounding the same, which is taken along the line IV-IV of FIG. 3, in the direction of the arrows.
Figure 5:
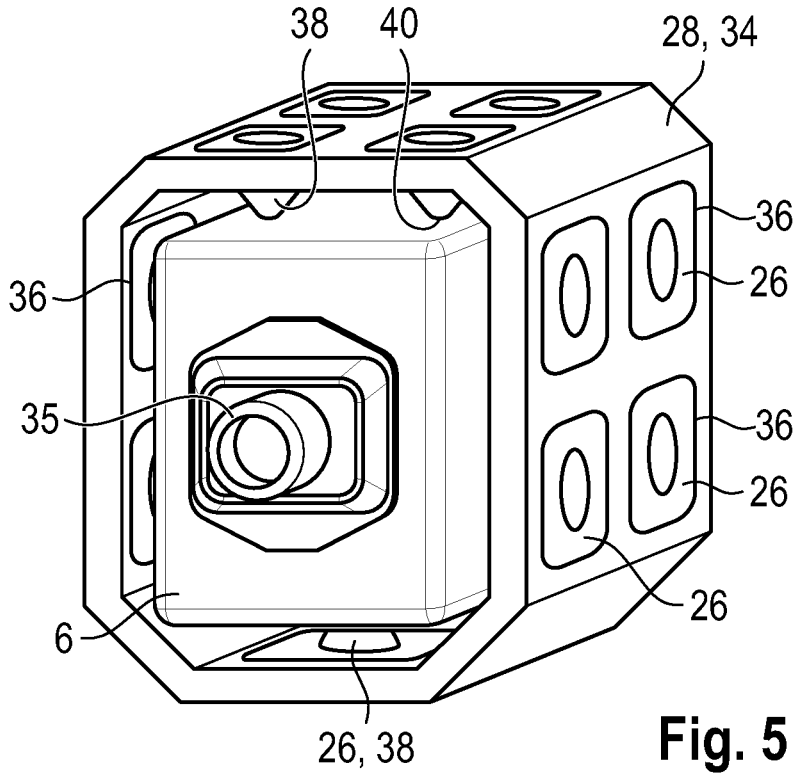
FIG. 5 is a perspective view of the elastic damping element and the cage of the coupling unit as well as the receiver mounted therein.

The cage 28, which is particularly visible in FIGS. 4 and 5, is formed by a tubular or pipe-like body 34 made from a dimensionally stable plastic, namely polyamide or polycarbonate, reinforced or unreinforced. In an alternative configuration the main body 34 is formed of a metal, for example a steel plate. The main body 34 has a roughly rectangular cross section, matched to the receiver 6, and encloses the side faces of the receiver 6 over their full extent. A sound outlet 35 of the receiver 6, and a rear side of the receiver 6 opposite the sound outlet 35, on the other hand, are disposed on the open sides of the main body 34. According to FIG. 5, all four side faces of the cage 28 are provided with breakthroughs 36 (i.e. openings which extend from the inner periphery or circumference of the main body 34 to its outer periphery or circumference).

In the illustrated embodiment, the damping element 26 is formed of a number of unconnected retaining tabs in the form of hollow conical studs 38, having distal ends (i.e. those facing away from the inner periphery or circumference of the main body 34) each of which form one contact surface 40 for the receiver 6. The conical studs 38 are formed of an elastic material (for example, a fluoroelastomer and/or a fluorosilicone elastomer), which is softer than the material of the cage 28 and, for example, has a Shore hardness (Shore A) of 20-25, in particular 23.

One of the studs 38 is introduced, in particular injected, into each breakthrough 36 of the cage 28. Preferably, the cage 28 and the damping element 26 are produced together in a two-component injection molding process.

The damping body 30 is also made of an elastic material (for example, "Viton"). This material is preferably chosen in such a way that the damping body 30 is harder than the studs 38 of the damping element 26, but softer than the cage 28. For example, the material of the damping body 30 has a Shore hardness (Shore A) of 50-70, in particular 65.

The cap 32 is preferably made of a harder material than the damping body 30, e.g. from a dimensionally stable plastic. In an alternative configuration it is manufactured from the same material as the damping body 30.

The damping body 30 and the cap 32 are placed onto the cage 28 in such a way that they form a seal, so that they form a closed airtight shell or box around an air space, in which the receiver 6 is mounted. The cap 32 in this case has a through hole 41, through which the sound tube 22 connected to the sound outlet 35 of the receiver 6 is passed.

Two fixing elements in the form of braces 42 (i.e., web-like protrusions), which are formed at one end of the damping body 30 facing the battery 12, face each other at a distance and clamp the battery 12 between them. The battery 12 is thus fixed to the damping body 30 by the braces 42 with a force-locking connection (and hence free of play).

Electrical contacts 44, for contacting the battery 12, are integrated on the inner surfaces facing each other of the braces 42. The contacts are in turn connected to the wire 20 indicated in FIG. 1.

In addition, a further fixing element in the form of a plug or a pin 46 with a T-shaped cross section is formed on the damping body 30. The pin 46 is used to mount the electronic frame 14 on the damping body 30, and in order to do so it is inserted into a corresponding non-illustrated T-groove of the electronic frame 14. The pin 46 is manufactured with a predefined excess over the T-groove of the electronic frame 14, so that the pin 46 pressurizes the walls of the T-groove and fixes the electronic frame 14 to the damping body 30, not only with a form-locking connection, but also with a force-locking connection (and thus again without play). Optionally, electrical contacts are integrated into the pin 46 and the corresponding T-groove, through which the wires 18 and 20 indicated in FIG. 1 contact the signal processing unit 10.

A small projection 47, which is made of a soft material and is formed on a rear wall of the damping body 30 facing the battery 12, acts as a tolerance compensation in order to be able to securely accommodate batteries 12 with varying sizes due to manufacturing tolerances.

Through the use of the damping element 26, the cage 28 and the damping body 30, the receiver 6 is elastically coupled to the battery 12 and to the electronic frame 14. Due to this connection within the housing 4 a coherent assembly with relatively large mass is formed. In this composite structure, the receiver 6, the battery 12 and the electronic frame 14 react much more robustly against vibrations, particularly in the higher frequency range, than if they were individually mounted on the housing 4. Due to the high total weight of this module, the hearing instrument 2 also experiences effective vibration damping in the lower and middle frequency range. In particular, the vibrational energy emitted by the receiver 6 is dissipated effectively by the elastic damping element 26 and the elastic damping body 30.

The invention is particularly clearly described in the exemplary embodiments described above, but at the same time it is not limited to these exemplary embodiments. On the contrary, further embodiments of the invention can be derived from the claims and the above description.

The following is a summary list of reference numerals and the corresponding structure used in the above description of the invention.

LIST OF REFERENCE NUMERALS

2 hearing instrument
4 housing
6 receiver
8 microphone
10 signal processing unit
12 battery
14 electronic frame
16 coupling unit
18 wire
20 wire
22 sound tube
24 opening
26 damping element
28 cage
30 damping body
32 cap
34 main body
35 sound outlet
36 breakthrough
38 stud
40 contact surface
41 through hole
42 brace
44 contact
46 pin
47 projection

The invention claimed is:

1. A hearing instrument, comprising:
a housing;
a receiver;
at least one additional component mounted in said housing; and
a coupling unit providing a vibration-reduced mounting of said receiver, said coupling unit elastically coupling said receiver to said at least one additional component;
said coupling unit including a damping body made of rubber or an elastomer material, said damping body being coupled to said receiver and to said at least one additional component; and
said coupling unit including at least one fixing element for force-lockingly fixing said at least one additional component, said at least one fixing element being constructed integrally or in one piece with said damping body.

2. The hearing instrument according to claim 1, wherein said coupling unit includes a damping body made of rubber or an elastomer material, said damping body being coupled to said receiver and to said at least one additional component.

3. The hearing instrument according to claim 2, which further comprises:
a cage;
said damping body being fixed to said cage; and
said coupling unit including, in addition to said damping body, an elastic damping element for mounting said receiver and said cage;
said cage surrounding said elastic damping element.

4. The hearing instrument according to claim 3, wherein said elastic damping element and said damping body have a lower hardness than said cage.

5. The hearing instrument according to claim 4, wherein said elastic damping element has a lower hardness than said damping body.

6. The hearing instrument according to claim 3, wherein said elastic damping element has a lower hardness than said damping body.

7. The hearing instrument according to claim 1, which further comprises electrical contacts integrated into said coupling unit for contacting at least one of said battery or an electronic component.

8. A hearing instrument, comprising:
a housing;
a receiver;
at least one electronic component including a signal processing unit;
at least one additional component mounted in said housing, said at least one additional component being at least one of a battery or an electronic frame for supporting said signal processing unit; and
a coupling unit providing a vibration-reduced mounting of said receiver, said coupling unit elastically coupling said receiver to said at least one additional component.

* * * * *